US006606828B1

(12) United States Patent
Lin et al.

(10) Patent No.: US 6,606,828 B1
(45) Date of Patent: Aug. 19, 2003

(54) AERODYNAMIC ROOF EDGES

(76) Inventors: Jason Jianxiong Lin, 322 Stromer Dr., Cary, NC (US) 27513-2753; Liddy Miaoli Chen, 322 Stromer Dr., Cary, NC (US) 27513-2753

( * ) Notice: Subject to any disclaimer, the term of this patent is extended or adjusted under 35 U.S.C. 154(b) by 0 days.

(21) Appl. No.: 10/017,313

(22) Filed: Dec. 6, 2001

Related U.S. Application Data

(60) Provisional application No. 60/254,461, filed on Dec. 9, 2000.

(51) Int. Cl.[7] ..... E04D 3/38; E04D 3/40; B61D 17/02

(52) U.S. Cl. ..... 52/58; 52/60; 52/84; 52/96; 52/300

(58) Field of Search ..... 52/58, 60, 84, 52/96, 300

(56) References Cited

U.S. PATENT DOCUMENTS

| | | | | |
|---|---|---|---|---|
| 3,012,376 | A | * | 12/1961 | Reddy |
| 3,024,573 | A | * | 3/1962 | McKinley |
| 3,187,464 | A | | 6/1965 | Sharp |
| 4,549,376 | A | | 10/1985 | Hickman |
| 4,598,507 | A | | 7/1986 | Hickman |
| 4,665,667 | A | | 5/1987 | Taylor et al. |
| 4,780,999 | A | * | 11/1988 | Webb |
| 4,858,406 | A | | 8/1989 | Lane et al. |
| 5,031,367 | A | * | 7/1991 | Butzen |
| 5,189,853 | A | * | 3/1993 | Braine |
| 6,212,829 | B1 | * | 4/2001 | Webb |

OTHER PUBLICATIONS

MM Systems Corp. Snap–Lok Coping Systems (Bullnose Coping), Advertising Web Page, Nov. 6, 2000, http: www.colliersf.com/mmcoping.

MM Systems Corp. , Fascia Systems (Vari–Fascia) Advertising Web Page, Nov. 6, 2000, http : 11www.colliersf.com/mmfascia.

J.X. Lin & D. Surry, Supressing Extreme Suction . . . , Cont. Proc.7$^{th}$ US National Conf. on Wind Engineering, Jun. 27, 1993, p. 418, vol. 1, UCLA, Los Angeles, USA.

D. Surry & J.X. Lin, The Effect of Surroundings and Roof Corner Geometric . . . , Journal of Wind Engorg. & Industrial Aerodynamics, 1995, p. 121, vol. 58, Elsevier ,Amsterdam, The Netherlands.

Metal–Era, Roof Edge Systems, Catalog No. 79709000, 1997, p. 4, p. 8 & p. 9, Metal–Era, Inc., Waukesha ,WI, USA.

* cited by examiner

*Primary Examiner*—Carl D. Friedman
*Assistant Examiner*—Kevin McDermott

(57) ABSTRACT

A roof edge fascia or coping cover having an aerodynamic exterior shape mainly comprising a lower face portion, an intermediate face portion, and a top face portion. The lower face portion is either generally vertical, or sloping or curving upwardly and outwardly, forming an angle within 60° to the vertical outer wall surface of a building. The top face portion, of a substantial lateral size, is generally disposed within ±25° from horizontal. The intermediate face portion, having at least one segment of a substantial lateral size sloping or curving upwardly and inwardly, connects the lower and top face portions. Slope changes at a junction between any two adjacent face portions, or adjacent segments thereof, are generally less than or equal to 50°. Through controlling surface slope changes systematically, this invention ensures an aerodynamic roof edge configuration that effectively mitigate airflow separation from the building surface so as to suppress vortex formation and reduce adverse wind actions on a roof construction.

2 Claims, 9 Drawing Sheets

AERODYNAMIC ROOF EDGES

CROSS-REFERENCE TO RELATED APPLICATIONS

This application is entitled to the benefit of Provisional Patent Application Serial No. 60/254,461, filed Dec. 9, 2000.

BACKGROUND

1. Field of Invention

This invention relates to building roof edge systems, specifically to the fascia cover, coping cover or other such roof edge cover of a fascia assembly, gravel stop assembly, coping assembly or other such building component assembly.

2. Discussion of Prior Art

Conventionally roof edge systems are intended to provide aesthetic roofing termination and waterproof along the perimeter of a flat or nearly flat roof. However, conventional roof edge systems are not aerodynamically configured, adversely affecting not only their performance under the action of wind, but also the performance of other parts or components of the roof under wind action, for example, wind action resulting from hurricanes, tornadoes or winter storms.

Prior Art FIGS. 1A and 1B show examples of the most common shapes of fascia covers presently used on roof edge systems. An abrupt change of surface slopes at the top arris of the fascia cover renders conditions for the generation of wind-induced vortices over the roof edge system and the roof at large, due to extremely high local airflow speed at the arris and inevitably severe flow separation from the downstream surface, a phenomenon that is inherent to such an abrupt slope change. Vortices create strong uplift forces that prove to be the prime cause of roof failures during high winds. Vortices also scour or sweep up roofing material, such as roof gravel or paver, which becomes a major source of wind-borne debris impacting and damaging adjacent structures.

Prior Art FIG. 2 shows a common shape of coping cover used on roof edge parapet walls. Similarly, the abrupt change of surface slopes at the outer top arris renders conditions for the generation of wind-induced vortices and strong uplift forces.

A handful of existing roof edge systems have elements that are intended for purposes other than aerodynamic ones but lead to some improvement in the aerodynamics of a roof edge system; however, lacking of a systematic aerodynamic design, they are of distance from being aerodynamically advanced, optimal or complete, each having identifiable flaws or disadvantages. Prior Art FIG. 3 shows a roof edge construction as disclosed in U.S. Pat. No. 4,780,999 to Webb and Hickman (1988). While intended for resilient anchoring, the shape of the fascia cover aerodynamically improves over that shown in Prior Art FIG. 1 because of reduction in abruptness of slope changes; however, the reduction is not sufficient to avoid high local airflow speed and large scale flow separation at the upper ridge of the fascia cover so that sizable vortices will inevitably occur above the inwardly and downwardly sloping portion as well as over the roof surface downstream. Another example of roof edge construction is shown in Prior Art FIG. 4 as disclosed in U.S. Pat. No. 4,598,507 to Hickman (1986) and also in U.S. Pat. No. 4,549,376 to Hickman (1986). The still abrupt slope changes, particularly at the upper front edge, make the shape of the fascia cover aerodynamically faulty. Prior Art FIG. 5 shows a coping assembly as disclosed in U.S. Pat. No. 6,212,829 B1 to Webb et. al. (2001). While intended for improved longitudinal alignment between adjacent coping covers, the cross-sectional shape of the coping cover is also aerodynamically improved over the more common shape shown in Prior Art FIG. 2, in light of mitigating vortex formation over the top face portion of the fascia cover; however, the blunt shape of the underside of the outer protruding cap portion, which forms a right angle with the wall, increases upward wind pressure load due to flow stagnation on the underside of the outer cap portion. This high pressure will also potentially be transmitted to the inside chamber of the coping cover due to any imperfect air tightness between the cover's lower edge and the wall surface, pressurizing the inside chamber and resulting in undesired additional upward load on the top horizontal portion and outward force on the outer cap portion. In addition, these increased pressures will impose a stronger force to press rainwater present in the vicinity of the coping cover's lower edge upwards into the cover's chamber, exposing the internal components to wetting problems which the coping cover were supposedly to protect them from. This undermines the roof edge system's functionality as a waterproof component for the building even under less severe wind conditions. Moreover, such an outward protruding shape, having a large protrusion depth relative to its vertical dimension, along with a blunt underside shape, will also induce strong wind suction on the outermost exterior surface of the coping cover, added to the outward force due to the internal pressurization mentioned above, pulling it outward away from the wall. This action in turn worsens the scenario of any imperfect air and water tightness and increases internal pressurization. Such a potential chain action in a positive feedback mode, severely increases the chances of wind induced damage and forced water-infiltration under high winds. Prior Art FIG. 6 shows the shape of the outer part of an Overly Manufacturing Company's coping cover (date unknown), which also has a blunt lower cap portion, and has a large outward-protrusion depth. This configuration has similar faults as described for that in Prior Art FIG. 5. In addition, this configuration has a larger curvature on the front upper cap portion, which is more in favor of flow separation and vortex formation.

Prior Art FIG. 7 shows a fascia assembly as disclosed in U.S. Pat. No. 3,187,464 to Sharp (1965). While designed to provide a smooth appearing front exposed side, the rounded shape of the top ridge portion of the fascia cover slightly improves the fascia cover's aerodynamics over an otherwise sharp top arris shape; nevertheless, the curvature of the top ridge or hump is too large, or its radius is too small with respect to the overall size of the fascia cover, making it effectively equivalent to an abrupt or sharp change in surface slope.

A detail review of the prior art reveals a reality that none of the existing roof edge systems or designs is aerodynamically configured to effectively mitigate wind-induced vortices affecting roof edge systems and roof zones adjacent to the edge. According to one of the roof edge manufacturers, MM Systems Corporation, Inc., nearly 75% of all incidents of roof blow-off occur at the roof edge (http://www.advanced-roofing.com/productservices/mmsc.htm, as of Nov. 16, 2000). In a news article related to the American National Standards Institute's approval of Wind Design Standard for Edge Systems Used with Low Slope Roofing, it was claimed that 90% of the damage begins with wind and water leaks at the roof edge (Southern Building magazine, January/February, 1999). An Institute for Business and Home Safety article, Performance of Metal Building in High Winds, depicts that "high winds have peeled roof coverings back from roof edges like a metal key peels open a can of sardines". Many other publicly available post-disaster survey data show that flat or nearly flat roof construction is one of the most wind-vulnerable structures and majority of the wind-induced damages start from the roof edge. In response to such a reality, American Society of Civil Engineers' Standard ASCE 7-98 "Minimum Design Loads for Buildings and Other Structures", as a national standard, specifies significantly higher wind loads on edge zones (including corners) of a roof than any other part of a building for structural strength requirement. Also nearly all official building codes observed within various jurisdictions of the United States and other countries, including IBC, SBC, UBC, BOCA, FBC, SFBC and NBC, have similarly stringent provisions for the roof edge zones.

Clearly, there is an urgent need in the industry and marketplace for aerodynamically advanced, systematically and coordinately configured roof edge systems to reduce wind actions on both the edge system and the edge zones of a roof While strengthening a structure has been, and continues to be, one of the solutions for safer roofs, a more physically fundamental solution is indeed to reduce the wind actions or the wind-induced forces themselves on the structure by using aerodynamic passive flow control methods as described in the present invention. While new constructions must be designed to meet the structural strength requirements stipulated by various building codes, incorporating an aerodynamic roof edge system instead of a conventional one will provide double protection to achieve safer roof and building constructions. For wind resistant retrofits of existing buildings, replacing a conventional roof edge system with an aerodynamic roof edge system will be more economical than replacing or renewing a roof structure or even a part of a roof structure, since the aerodynamic method will cost significantly less material and labor, and does not necessitate temporary removal of occupants and contents or interruption of business, and thus is more cost-effective.

SUMMARY

In accordance with the present invention, aerodynamic roof edge systems comprise a streamlined or nearly streamlined fascia cover, coping cover or other such roof edge cover, of which slope changes between adjacent surfaces are systematically and coordinately controlled, reducing the intensity and size of wind-induced vortices generated at the roof edge and over the roof edge zone that potentially cause damage to the roof edge system and the roof in general.

OBJECTS AND ADVANTAGES

Accordingly, several objects and advantages of the present invention are:

- to provide roof edge systems which minimize the chance of damage to roof edge systems under severe wind conditions, and thus safeguard the integrity of a roof structure;
- to provide roof edge systems which also reduce wind-induced uplift load on other parts of the roof, protecting them from windstorm damage;
- to provide roof edge systems which reduce vortex scouring of roofing materials, such as roof gravel, paver or other ballast, and prevent them from becoming wind-borne missiles injuring people and damaging adjacent building envelopes during windstorms;
- to provide roof edge systems which minimize accumulated displacement of roof gravel, paver or other ballast by moderate recurring winds, securing their functionality of protecting sheet membrane underneath from solar rays and wind uplift damage;
- to provide roof edge systems which stabilize wind flow over the roof edge system and other parts of a roof structure under moderate but frequently recurring wind conditions, thus reduce high-frequency cycling fatigue loads on these components and increase their service life;
- to provide roof edge systems which possess the desired aerodynamic performance to secure their conventional aesthetic and waterproofing functionality under both extreme and recurring weather conditions.

Further objects or advantages are to provide roof edge systems which retain all the original functions of a roof edge system, and which are still among the simplest, inexpensive to manufacture and convenient to install. These and still further objects and advantages will become apparent from a consideration of the ensuing description and drawings.

Figure 1A:
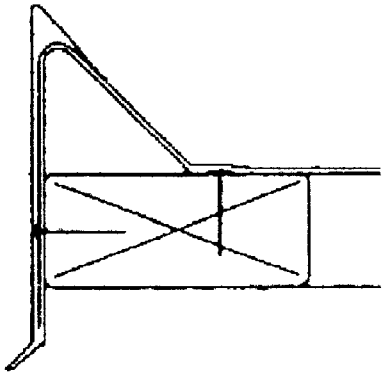
Figure 1A (PRIOR ART)
FIGS. 1A through 7 show prior art cited and discussed in this application.
Figure 1B:
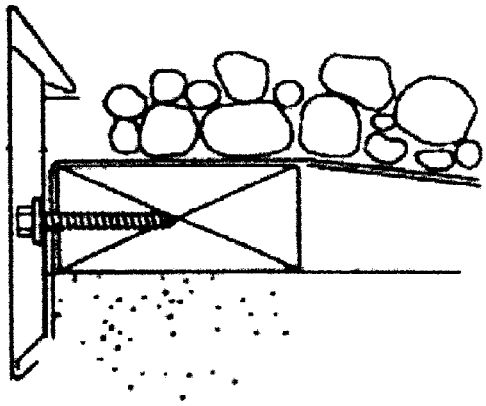
Figure 1B (PRIOR ART)
Figure 2:
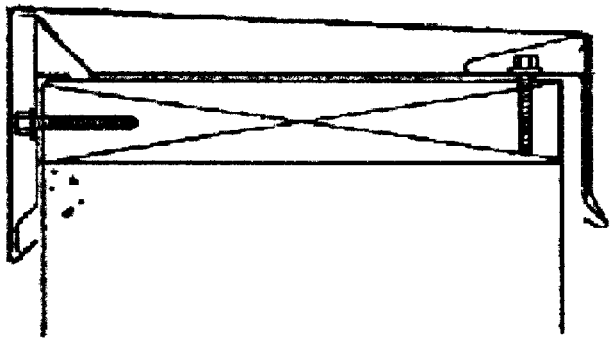
Figure 2 (PRIOR ART)
Figure 3:
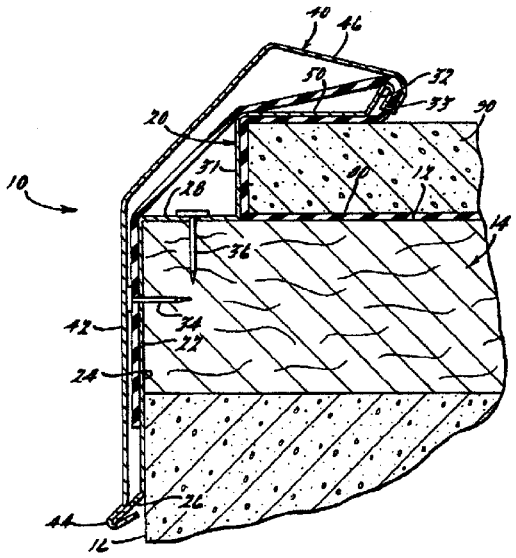
Figure 3 (PRIOR ART)
Figure 4:
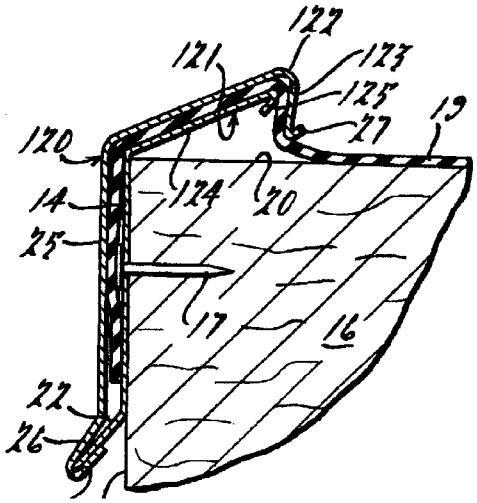
Figure 4 (PRIOR ART)
Figure 5:
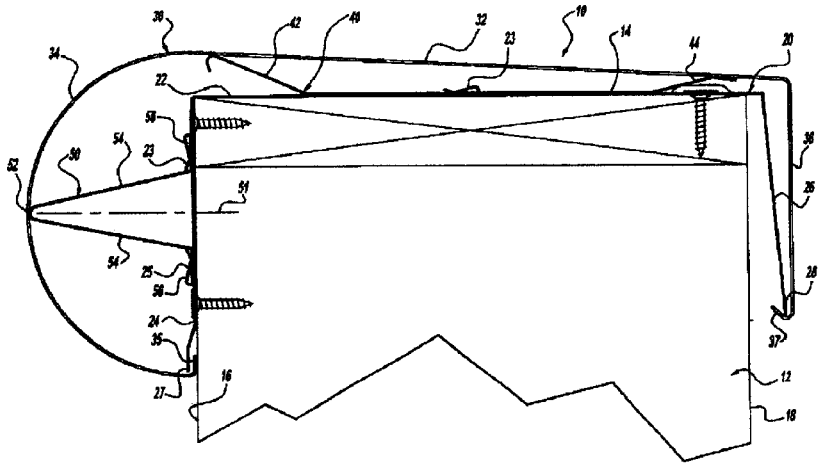
Figure 5 (PRIOR ART)
Figure 6:
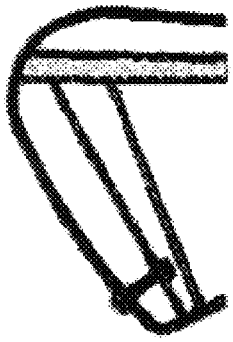
Figure 6 (PRIOR ART)
Figure 7:
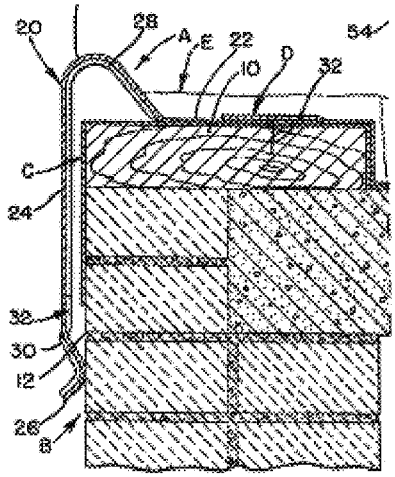
Figure 7 (PRIOR ART)

Throughout the above-listed figures and the following descriptions, a reference numeral system is used such that a reference numeral for an element shown in a figure begins with the figure number, followed by a two-digit number. Among various embodiments shown in different figures, elements having identical trailing two-digit number will have similarity or equivalency at least in some aspect of their configuration and/or functionality, and will be referred to as counterparts among embodiments.

DESCRIPTION OF THE PREFERRED EMBODIMENTS

FIGS. 8 through 11 illustrate several exemplary preferred embodiments of aerodynamic roof edge systems in accordance with the present invention. It should be noted that the present invention is also applicable in roof edge assemblies for building structures other than those shown for purposes of illustration in the drawings, as well as in other applications for forming building edge constructions.

Figure 8A:
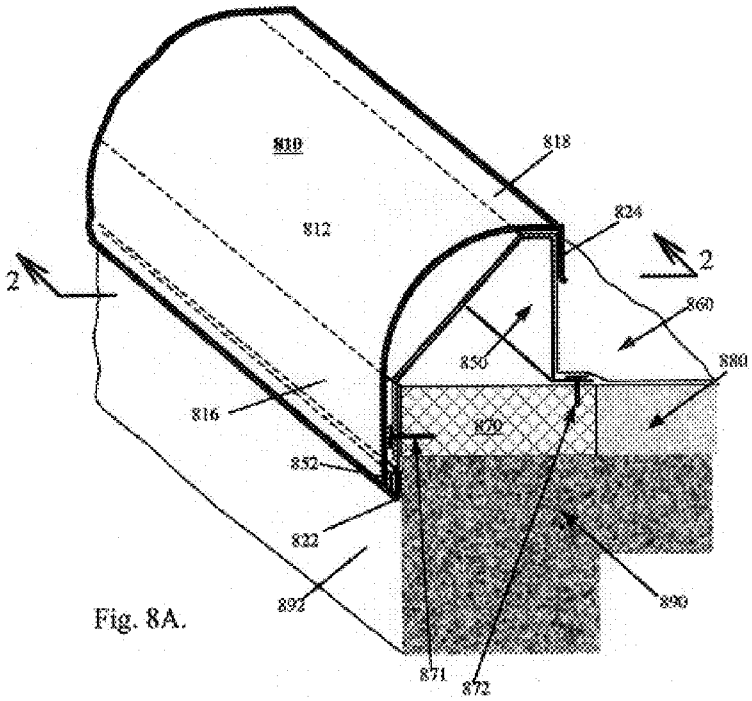
FIG. 8 is a partial perspective view of a portion of a roof edge fascia assembly according to this invention installed on an exemplary roof edge construction. A cross-section of the assembly is illustrated at the near end of the perspective view, showing the curved shape of the fascia cover.
FIG. 8B is a lateral cross-sectional view taken generally along line 2—2 of FIG. 1A.
FIG. 8C is a cross-sectional view depicting the manner in which a fascia cover or such roof edge cover is assembled onto the mounting and supporting structure.
Figure 8B:
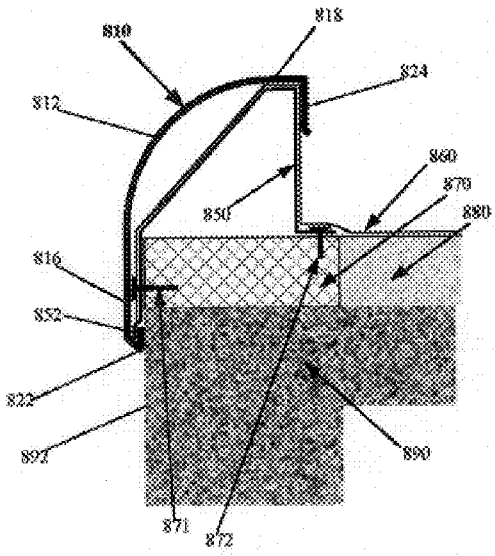

In FIGS. 8A and 8B, a preferred aerodynamic roof edge cover or fascia cover 110, as intended for gravel stop or edge fascia assemblies, generally includes a vertical lower face portion 116, an upwardly and inwardly curving intermediate face portion 112, a horizontal top face portion 118, a channel-shaped bottom anchor 122 and a back anchor portion 124. The fascia cover 110 is made of a resilient sheet material, such as extruded or formed sheet metal. For installation the fascia cover 110 is placed on a mounting frame/water dam 150 and is urged downward, as shown in FIG. 1C, by pressing on the intermediate face portion 112 until its bottom anchor 122 is engaged onto an edge clip 152 of the mounting frame/water dam 150. The fascia cover 110 resiliently clamps onto the mounting frame/water darn 150 and is anchored in place by the bottom anchor 122 and the back anchor portion 124 of the fascia cover 110. A bottom anchor of conventional drip-edge type, as in most of the prior art edge covers shown in this application, is acceptable if its size is sufficiently small, although it is not preferred aerodynamically.

The mounting frame/water dam 850 is fastened onto a wood member 870 with fasteners 871 and 872, while the wood member 870 is anchored to building substrate 890 using any feasible means such as anchor bolts (not shown). A sheet-like waterproof roofing material such as a membrane 860, which covers other roof construction members such as insulator 880, preferably extends over the fastener 872, wraps over the mounting frame/water dam 850 and is fastened by the fastener 871. Adhesive (not shown) may be applied between the membrane 860 and other members such as the insulator 880, wood member 870, fastener 872 and mounting frame/water dam 850. Roof ballast material (not shown) such as gravel or paver may be placed on and above the membrane 160, and against the back of the mounting frame/water dam 850.

Figure 8C:
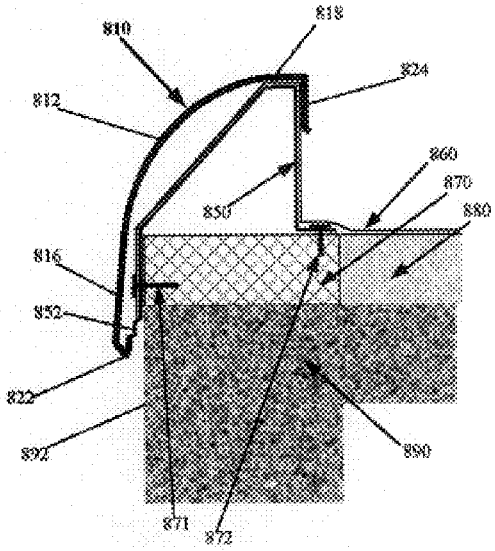

Streamlined and aerodynamically improved over conventional shapes of roof edge covers, the configuration of the fascia cover 810 furnishes gradual and smooth turning for the airflow that moves over a roof edge of a building, minimizing flow separation and mitigating vortex and uplift that adversely affect roof constructions. An intermediate face portion, preferably an upwardly and inwardly curving surface of substantial lateral size such as the one (812) in FIG. 8, and a generally horizontal top face portion of substantial lateral size such as the one (818) of FIG. 8, are essential for this mitigation purpose. A curving surface, such as the intermediate face portion 112, represents a continuous and gradual change in surface slope, guiding the wind flow to move across the roof edge smoothly, initially in a vertical direction parallel with a wall and eventually in a generally horizontal direction parallel to the roof surface, thus keeping airflow conform to the roof edge cover and roof surface as far downstream as necessary and as feasible. In FIG. 8, the horizontal top face portion 118, which connects to the intermediate face portion 812 in such a way that there is no slope change at their junction, further guides and stabilizes the airflow to be in a generally horizontal direction parallel to the roof surface.

Limited flow separation from the back anchor portion 824 is permissible, which generally reattaches to the roof surface shortly downstream and does not generate strong vortex given the configuration of the upstream face portions 816, 812 and 818 of the fascia cover 810. Thus the back anchor portion 824 can be vertical as shown, forming a right angle with the top face portion 818, or can be non-vertically extended downwards. The lower face portion 816 is preferably vertical, in parallel with the exterior wall surface 892 of a building. The bottom anchor 822 is made as small in size as allowed for secure anchoring, and as closely attached to the wall surface 892 as feasible, so that upward movement of airflow from the wall surface 892 onto the lower face portion 816 has minimal stagnation. Moreover, a horizontal top face portion, or one in parallel with the roof surface, is generally preferred, as shown in FIG. 8, as well as for all embodiments illustrated in this application; however, a non-horizontal top face portion is acceptable as far as it does not deviate from horizontal more than ±25° for a flat or nearly flat roof surface.

The fascia cover 810 can be mounted to the building structure in many ways. Any appropriate way is permissible. The mounting method described herein is only exemplary.

Figure 9:
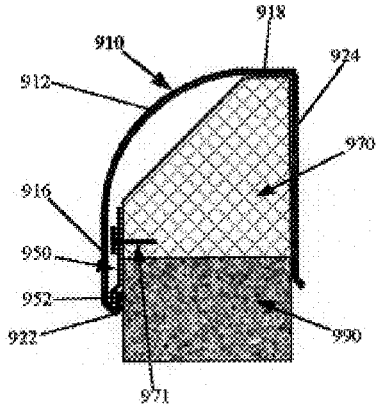
FIG. 9 is a cross-sectional view illustrating an aerodynamic coping cover mounted on top of a roof parapet wall.

FIG. 9 illustrates an aerodynamic coping cover 910 mounted on top of a roof parapet wall 990. Analog to the shape of the fascia cover 810 in above FIG. 8, the coping cover 910 is illustrated here primarily to demonstrate use of such aerodynamic edge shapes for roof parapet walls. The coping cover 910 also generally includes a lower face portion 916, an intermediate face portion 912, a top face portion 918, a bottom anchor 922 and a back anchor portion 924. The coping cover 910 resiliently clamps onto a wood nailer 970, and is anchored by the bottom anchor 922, which is snapped onto a bent portion 952 of a cleat 950, and by the back anchor portion 924. The cleat 950 is fastened with a fastener 971 onto the wood nailer 970, which is anchored atop a parapet wall 290 using any feasible means such as anchor bolts (not shown). A wood member or wood nailer is used as supporting structure for the coping cover 910 here, nevertheless any other appropriate means as supporting structure is also acceptable.

Figure 10:
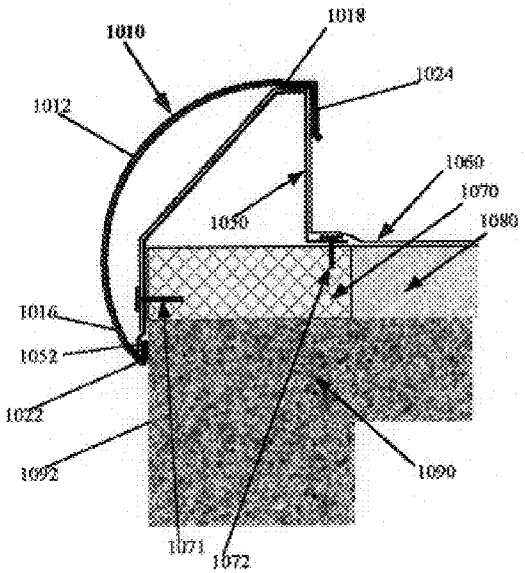
FIG. 10 illustrates another embodiment of the present invention, where a fascia cover has an outwardly protruding lower and intermediate portion that generally enlarges the lateral size of the fascia cover and augments its aerodynamic effectiveness.

FIG. 10 illustrates another embodiment of the present invention, where an outwardly extended fascia cover 1010 is shown as a modified version of the fascia cover 810 shown in FIG. 8. Herein a curving intermediate face portion 1012 extends outwardly and downwardly, and a non-vertical, curving lower face portion 316 extends outwardly and upwardly and smoothly connects with the intermediate face portion. Such a modified configuration increases the relative size, and reduces the curvature, of the intermediate face portion 1012, serving better the purpose of furnishing a gradual turn without separation for the airflow from vertical to horizontal over the roof edge system. Compared to that of FIG. 8, the configuration here will further reduce adverse wind action on the upper part of the fascia cover 1010 and generally on the roof, at the expense of slightly increasing outward pulling force on the outermost part of the intermediate face portion 1012 and the lower face portion 1016. It should be noted that when using a lower face portion that is not in parallel with, nor attaches to, an exterior wall surface, for example, the lower face portion 1016 in FIG. 10, the angle between such lower face portion and the wall surface should not exceed 60°.

All other elements present in FIG. 10 have configurations similar to their counterparts in FIG. 8. The individual functions and mutual relationships of all the elements in FIG. 10 are equivalent to those of their counterparts as disclosed in the description for FIG. 8.

Figure 11:
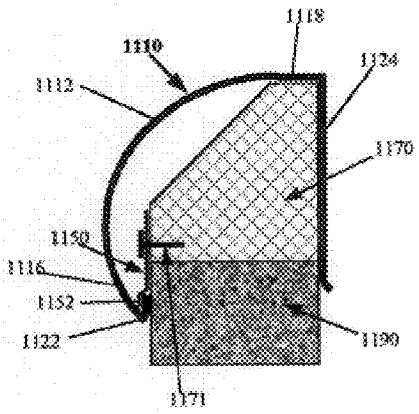
FIG. 11 is illustrative of an outwardly protruding coping cover mounted on a roof parapet wall.

FIG. 11 shows a coping cover 1110 which is a modified version of the coping cover 910 shown in FIG. 9. The coping cover 1110 here has similar aerodynamic advantages, and disadvantages, compared to the coping cover 910 in FIG. 9, as the fascia cover 1010 of FIG. 10 does to the fascia cover 810 of FIG. 8. All other parts present in FIG. 11 have configurations similar to their counterparts of FIG. 9. The individual functions and mutual relationships of all the elements here in FIG. 11 are equivalent or similar to those of their counterparts as described for FIGS. 8 and 9.

Alternative Embodiments

The above section describes the most preferred embodiments of this invention. Some alternate embodiments are illustrated in FIGS. 12 through 25 below, for which element numerals follow the same rules used in the above section, that is, elements having a similar role or equivalent function will be assigned the same trailing two-digit number and prefixed with their respective figure numbers. In the following descriptions for FIGS. 12 through 25, only new or modified elements are described in detail.

Figure 12:
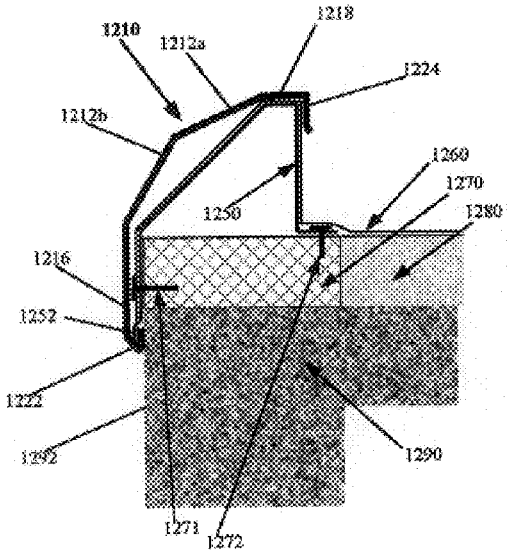
FIGS. 12 through 19 are cross-sectional views of various alternative embodiments of roof edge fascia or coping assemblies according to the present invention, for which generally sloping faces are used on the fascia or coping cover instead of curving faces as used for those of FIGS. 8 through 11.
Figure 13:
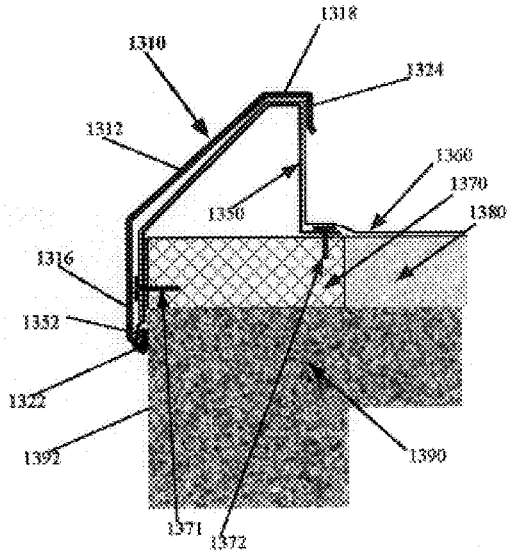

FIGS. 12 and 13 show two embodiments which are variations of the one shown in FIG. 8. In FIG. 12, two upwardly and inwardly sloping segments 1212*a* and 1212*b* replace the curving intermediate face portion 812 in FIG. 8. In FIG. 13, a single upwardly and inwardly sloping segment 1312 replaces the curving intermediate face portion 812 of FIG. 8. The slope change at a junction between adjacent face portions or adjacent segments therein should not be larger than 50° to maintain a nearly-streamlined configuration. The same will apply to any slope change between adjacent face portions or segments therein of a fascia cover, a coping cover or the like arising from the spirit of this invention. An angle formed between a top face portion and a back anchor portion, and angles formed in a normally small-sized bottom anchor portion, are not governed by this slope change rule. Their configurations presently described in this application, as well as other appropriate variations, impose little adverse aerodynamic effects on the system as discussed earlier for the embodiment of FIG. 8.

Figure 14:
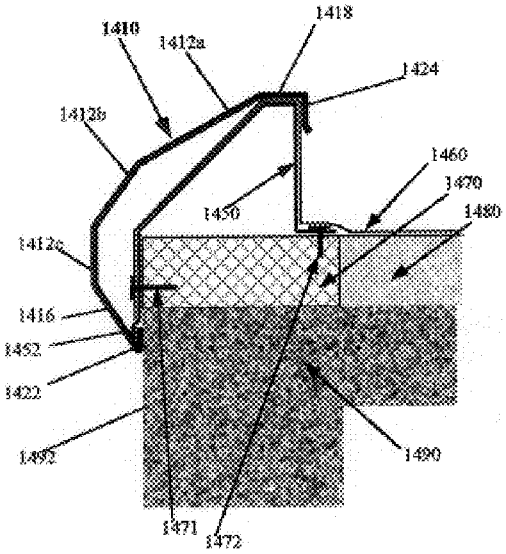
Figure 15:
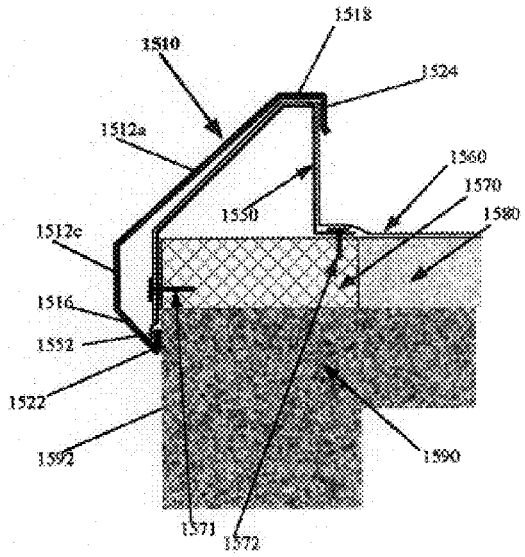

FIGS. 14 and 15 show two embodiments which are modified forms of the one shown in FIG. 10. In FIG. 14, several sloping or vertical segments 1412*a*, 1412*b*, 1412*c* and 1416 replace the curving, continuous intermediate and lower face portions 1012 and 1016 in FIG. 10. In FIG. 15, three sloping or vertical segments, 1512*a*, 1512*c* and 1516, replace the curving and continuous intermediate and lower face portions 1012 and 1016 in FIG. 10. Again, the slope changes between adjacent face portions or segments thereof should not be larger than 50°.

Figure 16:
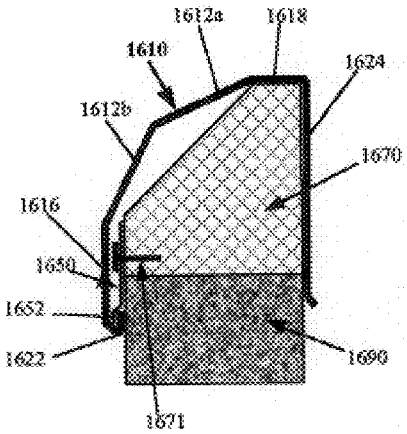
Figure 17:
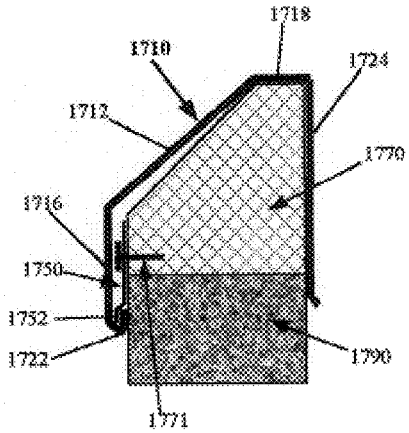

FIGS. 16 and 17 illustrate alternative forms of the one shown in FIG. 9. In FIG. 16, sloping segments 1612*a* and 1612*b* replace the curving intermediate face portion 912 in FIG. 9. In FIG. 17, a single sloping segment 1012 replaces the curving intermediate face portion 912 of FIG. 9.

Figure 18:
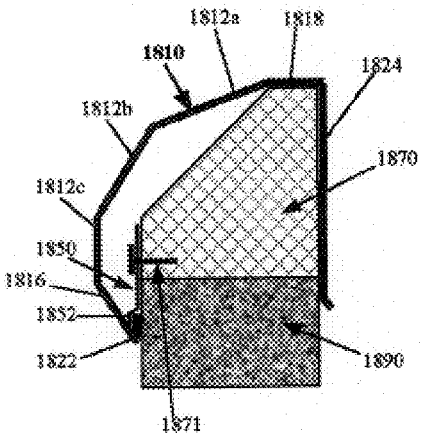
Figure 19:
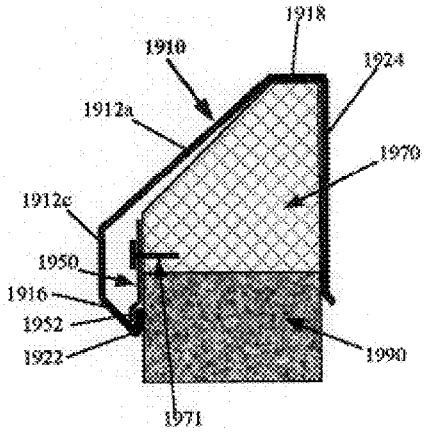

FIGS. 18 and 19 show another two alternate embodiments respectively, in which, a plurality of sloping or vertical segments, 1812*a*, 1812*b*, 1812*c* and 1816 in FIG. 18, or 1912*a*, 1912*c* and 1916 in FIG. 19, replace the curving, continuous intermediate and lower face portions 1112 and 1116 in FIG. 11.

FIGS. 20 through 25 show additional embodiments of this invention. Referred to FIG. 20, a fascia cover 2010 generally includes an intermediate face portion that consists of multiple curving or sloping segments, here for example a sloping segment 2012*a* and a curving segment 2012*d*. The fascia cover 2010 also includes a sloping lower face portion 2016 and a horizontal top face portion 2018 which, along with the intermediate face portion, form the crucial part of a passive flow control device. The fascia cover 2016 of FIG. 20 further includes a bottom anchor portion 2022 and a back anchor portion 2024 for installation, as an example for illustration purpose.

The fascia cover 2010 is made of a resilient sheet material, such as extruded or formed sheet metal. For installation the fascia cover 2010 is first aligned onto the top of a mounting frame 2050, here also as a water dam, where disposed in between is a watertight sheet-like roofing material such as a membrane 2060. The fascia cover 2010 is then urged downward and inward by pressing on the sloping segment 2012*a* and the curving segment 2012*d*, until its bottom anchor 2022 engages a lower edge clip 2052 of the mounting frame/water dam 2050. The fascia cover 2010 resiliently cramps onto the mounting frame/water dam 2050 and is anchored in place by the bottom anchor 2022 and the back anchor portion 2024. The installation of the other parts of the assembly here is significantly similar to that described for the assembly of FIG. 8.

Figure 21:
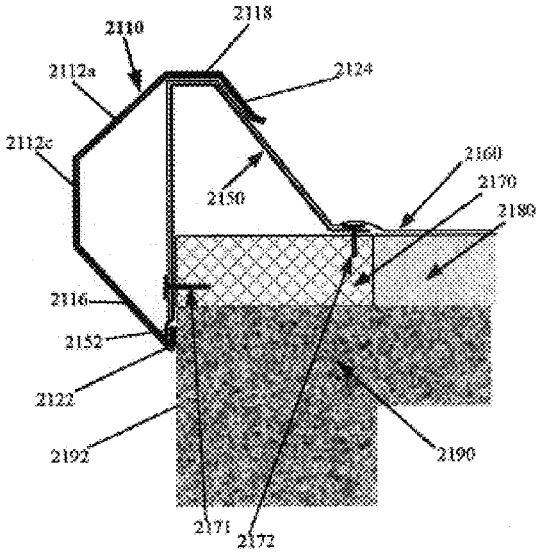

FIG. 21 simply shows another exemplary embodiment. For the fascia cover 2110 of FIG. 21, an intermediate face portion consisting of a sloping segment and a vertical segment is employed. This is just another exemplary configuration that can be drawn from the spirit of this invention, and is not to limit the scope of it.

Figure 20:
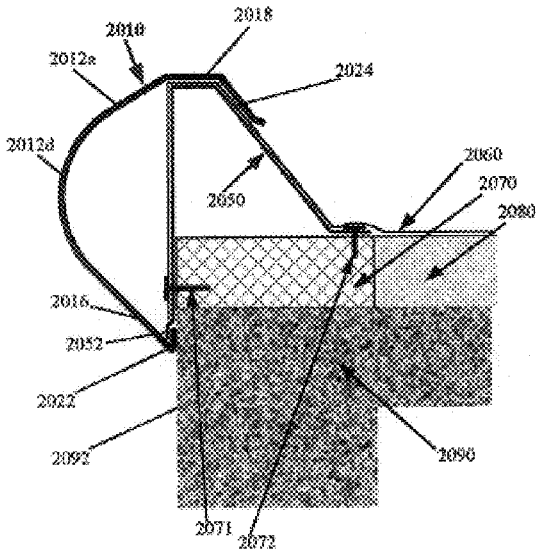
FIGS. 20 through 25 illustrate various embodiments of an overhanging version of fascia or coping cover according to the present invention.
Figure 22:
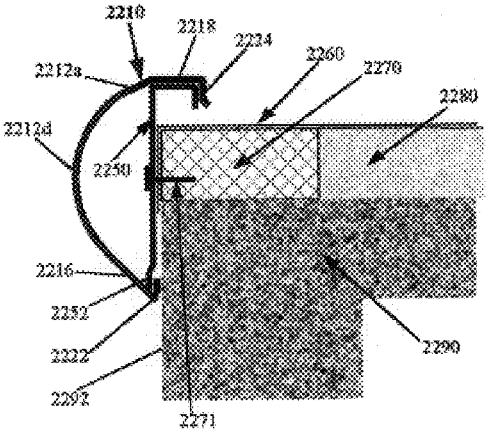
Figure 23:
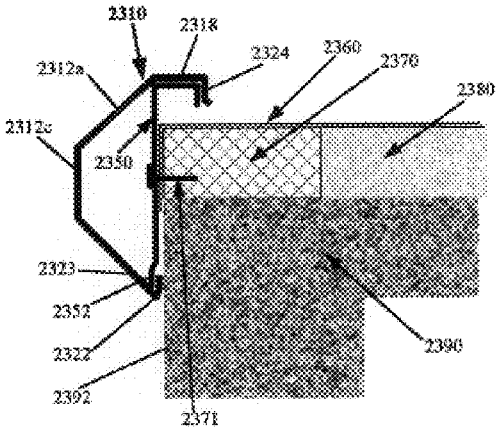

FIGS. 22 and 23 illustrate two additional embodiments, for which the fascia covers 2210 and 2310 are largely similar to those of FIGS. 20 and 21, but are mounted on a simplified mounting mechanism 2250 or 2350. Such assemblies are used as a simplified aerodynamic edge fascia system without having a water-dam function.

Figure 24:
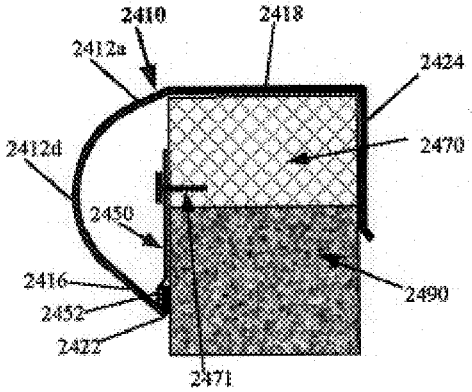
Figure 25:
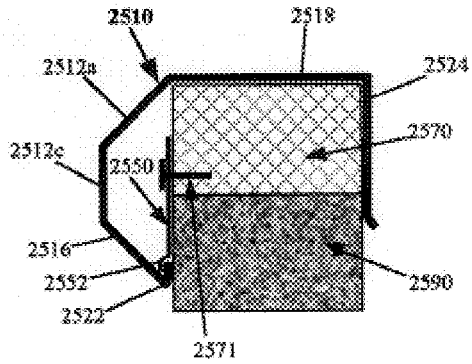

FIGS. 24 and 25 show two additional embodiments as used for coping systems, for which the coping covers 2410 and 2510 are, in principle, similar to the fascia covers 2010 and 2110 of FIGS. 20 and 21, and 2210 and 2310 of FIGS. 22 and 23, respectively. The differences are mainly associated with the top portion 2418 or 2518, and with the back anchor portion 2424 or 2524, which are extended in width to fit a underlying parapet wall structure and provide waterproof for it.

Operation

An embodiment of this invention is of the kind of passive flow control device for building roofs. Once it is installed, it stays functioning in such a way that it mitigates vortex formation at a roof edge and reduces uplifts and roof vortex scouring, whenever the wind blows towards a building bearing atop such roof edge devices.

Conclusion, Ramifications, and Scope

It is apparent that roof edge systems of this invention provides aerodynamically advantageous roof edge construction, and at the same time retains all original functions of a roof edge system, and is still among the simplest, inexpensive to manufacture and convenient to install.

Although the description above contains many specifications, these should not be construed as limiting the scope of the invention but as merely providing illustrations of some of the presently preferred embodiments of this invention. Various changes, modifications, variations can be made therein without departing from the spirit of the invention. For example, various portions of a fascia cover, coping cover or such edge cover can be fabricated separately and then appropriately interconnected or assembled, instead of being a continuous member as shown for all the above given examples. It can also be made of any solid, durable and resilient material with any appropriate means of fabrication, which includes formed or extruded sheet metal. Various face portions of an edge cover may also bear such surface details as corrugation or steps of adequate sizes, as opposed to perfectly smooth surfaces. The lower and back anchor portions could be in various appropriate shapes and sizes other than those shown in the exemplary drawings, or even a different means to support and secure the roof edge cover can be used, without departing from the spirit of this invention. The present invention is also applicable in roof edge assemblies for building structure other than that shown for purposes of illustration in the drawings, as well as in other applications for forming building edge constructions such as vertical wall edges. Thus the scope of the invention should be determined by the appended claims and their legal equivalents, rather than by the examples given.

We claim:

1. An assembly for forming a roof edge on a building structure having generally horizontal or sloping roof surfaces and generally vertical outer wall surfaces, said assembly comprising:

(a) a fascia cover having at least a lower face portion, an intermediate face portion and a top face portion adjoining consecutively, wherein said lower face portion is either generally vertical, or sloping upwardly and outwardly, away from the outer wall surface and defines an angle within 60° with the outer wall surface where the lower face portion contacts the outer wall surface.

said top face portion, or at least one segment thereof, having a substantial lateral size and generally being disposed on or above a perimeter of said roof surface and within ±25° of horizontal;

said intermediate face portion, connecting said lower face portion and said top face portion, having at least one segment of substantial lateral size sloping or curving substantially upwards and inwards;

and wherein slope change across a junction between any adjacent two of the face portions, or of segments therein, being generally less than or equal to 50°;

whereby to reduce upward and outward aerodynamic forces on said fascia cover and said roof surface;

(b) means of supporting and securing said fascia cover onto said building structure.

2. A coping assembly for forming a roof edge on a building structure having generally horizontal or sloping roof surfaces and generally vertical raised parapet walls on the perimeter of said roof surfaces, said coping assembly comprising:

(a) a coping cover having at least a lower face portion, an intermediate face portion and a top face portion adjoining consecutively, wherein said lower face portion is either generally vertical, or sloping upwardly and outwardly away from an outer surface of the raised parapet wall, an angle within 60° with the outer surface of said raised parapet wall; where the lower face portion contacts the outer surface of the raised parapet wall.

said top face portion, or at least one segment thereof, having a substantial lateral size and generally being disposed on or above said raised parapet wall and within ±25° of horizontal;

said intermediate face portion, connecting said lower face portion and said top face portion, having at least one segment of substantial lateral size sloping or curving substantially upwards and inwards;

and wherein slope change across a junction between any adjacent two of the face portions, or of segments therein, being generally less than or equal to 50°;

whereby to reduce upward and outward aerodynamic forces on said coping cover and said roof surface;

(b) means of supporting and securing said coping cover onto said raised parapet wall.

* * * * *

UNITED STATES PATENT AND TRADEMARK OFFICE

CERTIFICATE OF CORRECTION

PATENT NO. : 6,606,828 B1
APPLICATION NO. : 10/017313
DATED : August 19, 2003
INVENTOR(S) : Lin et al.

It is certified that error appears in the above-identified patent and that said Letters Patent is hereby corrected as shown below:

Column 10, line 17, after 'wall' delete "," and insert --and defines--.

Column 10, line 18, after 'wall' delete ";".

Signed and Sealed this

Twenty-second Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 6,606,828 B1
APPLICATION NO. : 10/017313
DATED : August 19, 2003
INVENTOR(S) : Jason JianXiong Lin It is certified that error appears in the above-identified patent and that said Letters Patent is hereby corrected as shown below:

In column 5, line 7, please change "110" to --810--;

In column 5, line 9, please change "116" to --816--;

In column 5, line 10, please change "112" to --812-- and "118" to --818--;

In column 5, line 11, please change "122" to --822--;

In column 5, line 12, please change "124" to --824-- and "110" to --810--;

In column 5, line 14, please change "110" to --810--;

In column 5, line 15, please change "150" to --850--;

In column 5, line 16, please change "1C" to --8C-- and "112" to --812--;

In column 5, line 17, please change "122" to --822-- and "152" to --852--;

In column 5, line 18, please change "150" to --850-- and "110" to --810--;

In column 5, line 19, please change "150" to --850--;

In column 5, line 20, please change "122" to --822--;

In column 5, line 21, please change "124" to --824-- and "110" to --810--;

In column 5, line 39, please change "160" to --860--;

In column 5, line 52, please change "112" to --812--;

In column 5, line 59, please change "118" to --818--;

In column 6, line 33, please change "290" to --990--; and

In column 6, line 43, please change "316" to --1016--.

Signed and Sealed this

Ninth Day of February, 2010

David J. Kappos

David J. Kappos
*Director of the United States Patent and Trademark Office*